US006855899B2

(12) United States Patent
Sotome

(10) Patent No.: US 6,855,899 B2
(45) Date of Patent: Feb. 15, 2005

(54) PUSH BUTTON DEVICE HAVING AN ILLUMINATOR

(75) Inventor: Yusuke Sotome, Tokyo (JP)

(73) Assignee: PENTAX Corporation, Tokyo (JP)

( * ) Notice: Subject to any disclaimer, the term of this patent is extended or adjusted under 35 U.S.C. 154(b) by 0 days.

(21) Appl. No.: 10/750,811

(22) Filed: Jan. 5, 2004

(65) Prior Publication Data

US 2004/0134765 A1 Jul. 15, 2004

(30) Foreign Application Priority Data

Jan. 7, 2003 (JP) ..... 2003-001478
Jan. 7, 2003 (JP) ..... 2003-001477

(51) Int. Cl.[7] ..... H01H 9/00
(52) U.S. Cl. ..... 200/317
(58) Field of Search ..... 200/310–317, 200/341–345, 520; 396/535, 543

(56) References Cited

U.S. PATENT DOCUMENTS 3,113,197 A * 12/1963 Green ..... 200/317
3,174,023 A * 3/1965 Doggart ..... 200/317
3,267,926 A * 8/1966 Ennis ..... 200/314
4,778,966 A * 10/1988 Obata et al. ..... 200/314
5,039,832 A * 8/1991 Polacek et al. ..... 200/317
5,288,957 A * 2/1994 Swaybill ..... 200/317
5,521,345 A * 5/1996 Wulc ..... 200/317

FOREIGN PATENT DOCUMENTS

JP 9-180572 7/1997
JP 2-208326 7/2002
JP 2-231086 8/2002

* cited by examiner

*Primary Examiner*—Michael A. Friedhofer
(74) *Attorney, Agent, or Firm*—Greenblum & Bernstein, P.L.C.

(57) ABSTRACT

A push button device for an electronic device includes an annular translucent member fixed to a body of the electronic device; a push button positioned in the annular translucent member to be capable of being depressed; a light emitter for illuminating the annular translucent member; a convex semi-cylindrical surface which is a portion of a complete cylindrical surface, and is positioned on a side of a space between the light emitter and the annular translucent member; and at least one photoreflective sheet adhered to the convex semi-cylindrical surface. An axis of the complete cylindrical surface extends in a direction substantially parallel to a direction along which the light emitter and the annular translucent member are aligned. A direction normal to a tangent plane to the convex semi-cylindrical surface extends toward the annular translucent member and the push button.

15 Claims, 9 Drawing Sheets

PUSH BUTTON DEVICE HAVING AN ILLUMINATOR

BACKGROUND OF THE INVENTION

1. Field of the Invention

The present invention relates to a push button device having an illuminator for illuminating an annular translucent member (seat or base) positioned around a push button.

2. Description of the Related Art

Electronic devices such as electronic cameras which are provided with a push button device having an illuminator for illuminating an annular translucent member positioned around a push button to indicate a predetermined condition (e.g., power-on condition) are known in the art. The annular translucent member is made of light-guiding resin (translucent resin) to which light rays emitted from a light emitter such as an LED are directly or indirectly introduced to illuminate the annular translucent member.

However, in conventional push button devices having an illuminator, a sufficient amount of light rays emitted from the light emitter are not introduced to the annular translucent member, which makes it impossible to illuminate the annular translucent member uniformly. This becomes conspicuous in the case where the light emitter cannot be disposed coaxially with the annular translucent member.

SUMMARY OF THE INVENTION

The present invention provides a push button device having an illuminator for illuminating an annular translucent member positioned around a push button, wherein the annular translucent member can be illuminated uniformly with efficiency by the illuminator even if a light emitter is provided offset from the axis of the annular translucent member.

The present invention has also been devised based on the findings of a desirable configuration of one or more photoreflective strip for introducing light rays emitted from a light emitter to the annular translucent member.

According to an aspect of the present invention, a push button device for an electronic device is provided, including an annular translucent member fixed to a body of the electronic device; a push button positioned in the annular translucent member to be capable of being depressed; a light emitter for illuminating the annular translucent member; a convex semi-cylindrical surface which is a portion of a complete cylindrical surface, and is positioned on a side of a space between the light emitter and the annular translucent member; and at least one photoreflective sheet adhered to the convex semi-cylindrical surface. An axis of the complete cylindrical surface extends in a direction substantially parallel to a direction along which the light emitter and the annular translucent member are aligned. A direction normal to a tangent plane to the convex semi-cylindrical surface extends toward the annular translucent member and the push button.

The annular translucent member can be made of translucent resin.

It is desirable for a radius of the complete cylindrical surface to be at least double a distance between the light emitter and the push button.

It is desirable for the push button to include a button body made of translucent resin, and an opaque cover cap which covers a top of the push button.

It is desirable for the convex semi-cylindrical surface to be a portion of a peripheral surface of a cylindrical capacitor.

The electronic device can be a camera.

It is desirable for the cylindrical capacitor to serve as a power source for supplying power to a built-in flash of the camera.

The push button device can serve as a power button of the camera.

In an embodiment, a push button device for electronic device is provided, including an annular translucent member fixed to a body of the electronic device; a push button positioned in the annular translucent member to be capable of being depressed; a light emitter for illuminating the annular translucent member; a convex semi-cylindrical surface which is positioned adjacent to the space between the light emitter and the annular translucent member to face the light emitter and the annular translucent member; and at least one photoreflective sheet adhered to the convex semi-cylindrical surface.

The present invention has also been devised in the light of the idea that the annular translucent member can be uniformly illuminated if the push button itself is also made of light-guiding resin to serve as a light guiding member for guiding light rays emitted from a light emitter to the annular translucent member.

According to another aspect of the present invention, a push button device for electronic device is provided, including an annular translucent member fixed to a body of the electronic device; a push button positioned in the annular translucent member to be capable of being depressed; and a light emitter for illuminating the annular translucent member. The push button includes a button body made of translucent resin, and an opaque cover cap which covers a top of the push button. The button body, the annular translucent member and the light emitter are positioned so that at least a part of light rays emitted from the light emitter is incident on the annular translucent member through the button body.

It is desirable for the push button device to include a molded button portion with which the button body is formed integral, the molded button portion including a fixing portion which is fixed to a stationary member of the electronic device; and a resilient arm which connects the button body with the fixing portion. The molded button portion is molded from translucent resin.

It is desirable for the annular translucent member and the fixing portion of the molded button portion to be fixed to an exterior member of the electronic device, and the light emitter to be positioned internal side of the fixing portion.

It is desirable for the button body and the fixing portion to be adjacent to each other. The resilient arm projects from the fixing portion so that a tip of the resilient arm is fixed to the button body on a portion thereof on an opposite side of the button body from the fixing portion.

The electronic device can be a camera.

The push button device can serve as a power button of the camera.

The present disclosure relates to subject matter contained in Japanese Patent Applications Nos.2003-001477 and 2003-001478 (both filed on Jan. 7, 2003) which are expressly incorporated herein by reference in their entireties.

BRIEF DESCRIPTION OF THE DRAWINGS

The invention will be discussed below in detail with reference to the accompanying drawings, in which.

DESCRIPTION OF THE PREFERRED EMBODIMENT

Figure 1:
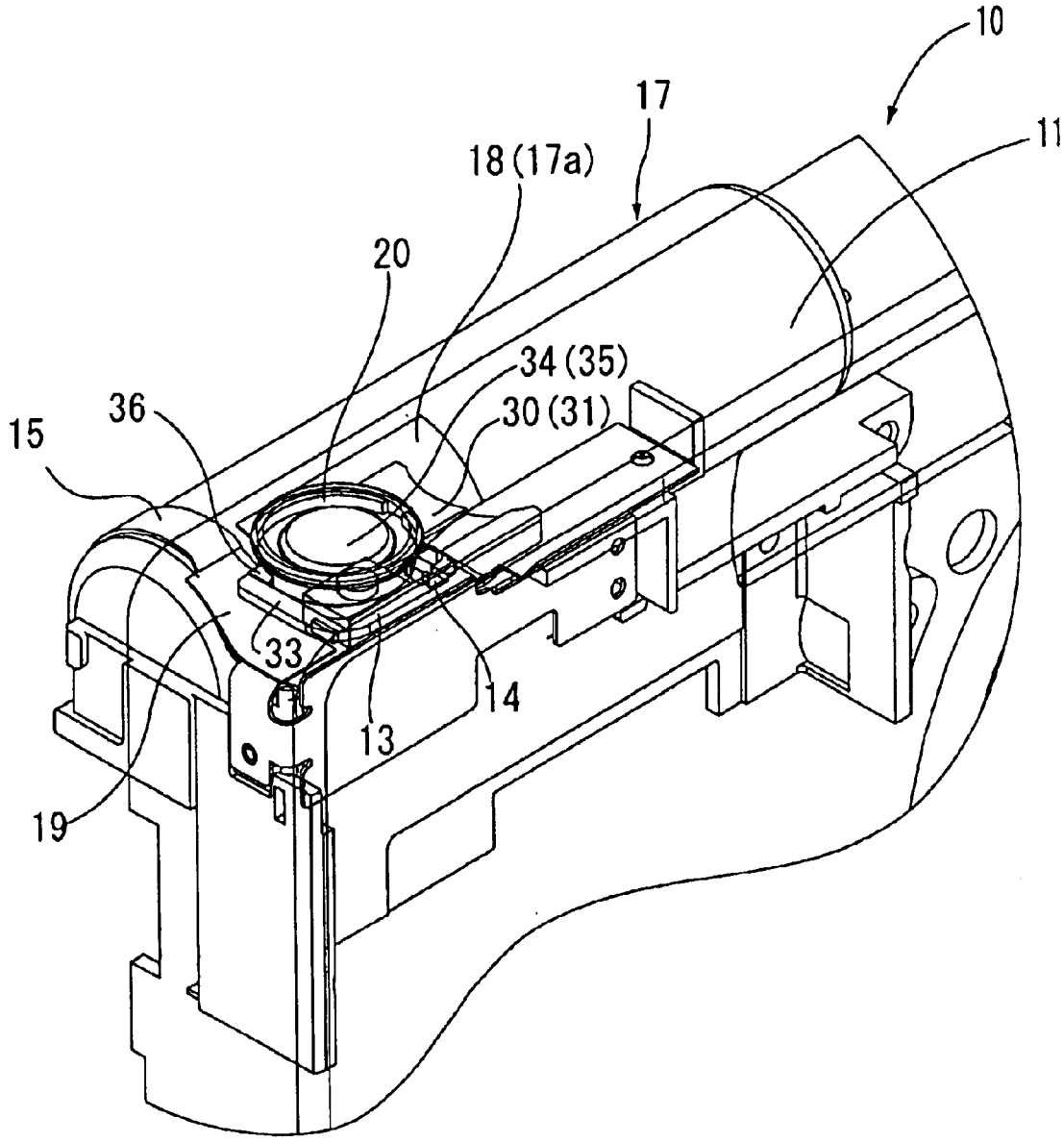
FIG. 1 is a fragmentary perspective view of an embodiment of a push button device according to the present invention which is incorporated in a camera.
Figure 2:
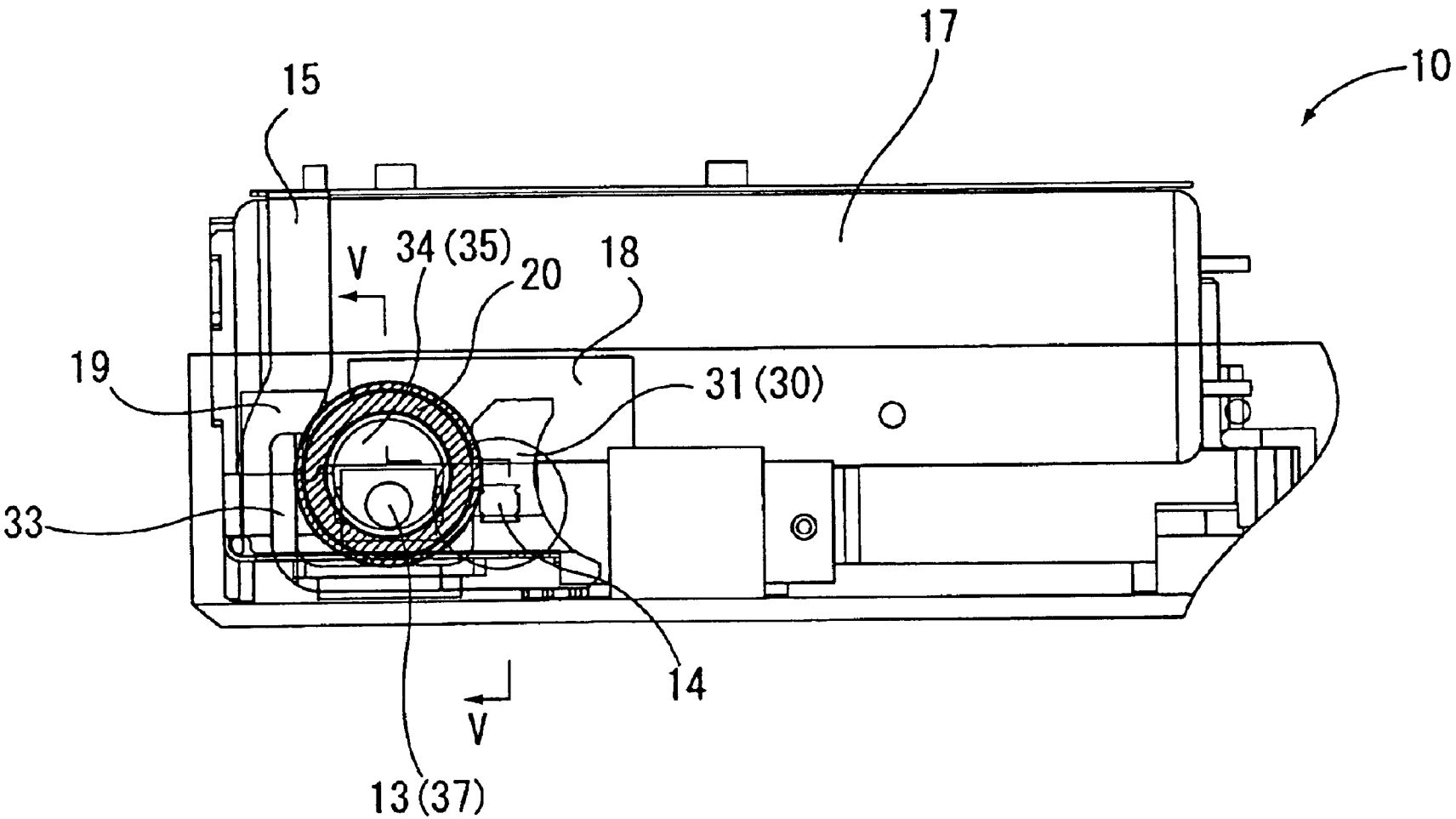
FIG. 2 is a plan view of the push button device shown in FIG. 1.
Figure 3:
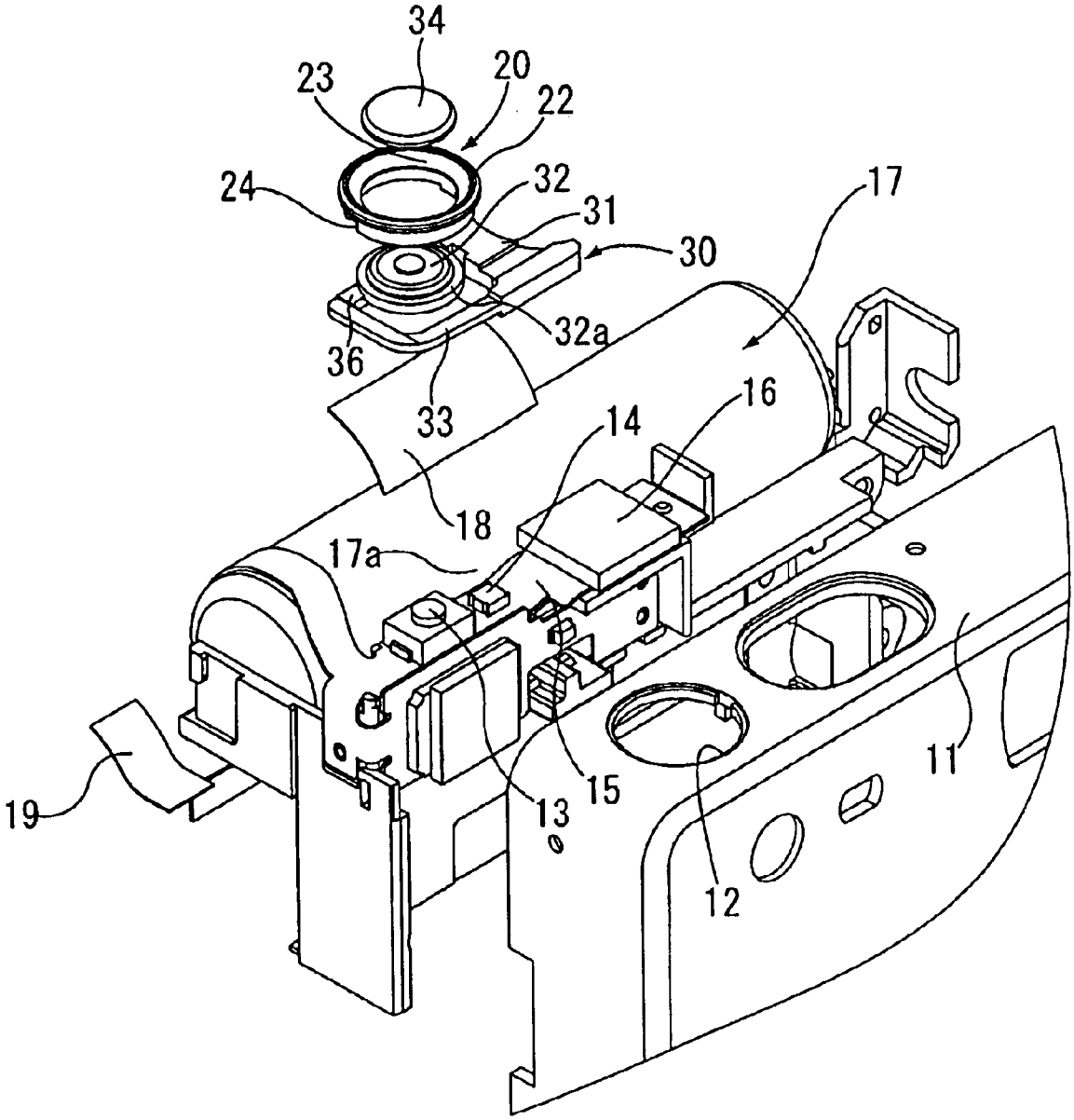
FIG. 3 is an exploded perspective view of the push button device shown in FIG. 1, showing a state before photoreflective strips are adhered to a peripheral surface of a cylindrical capacitor.
Figure 4:
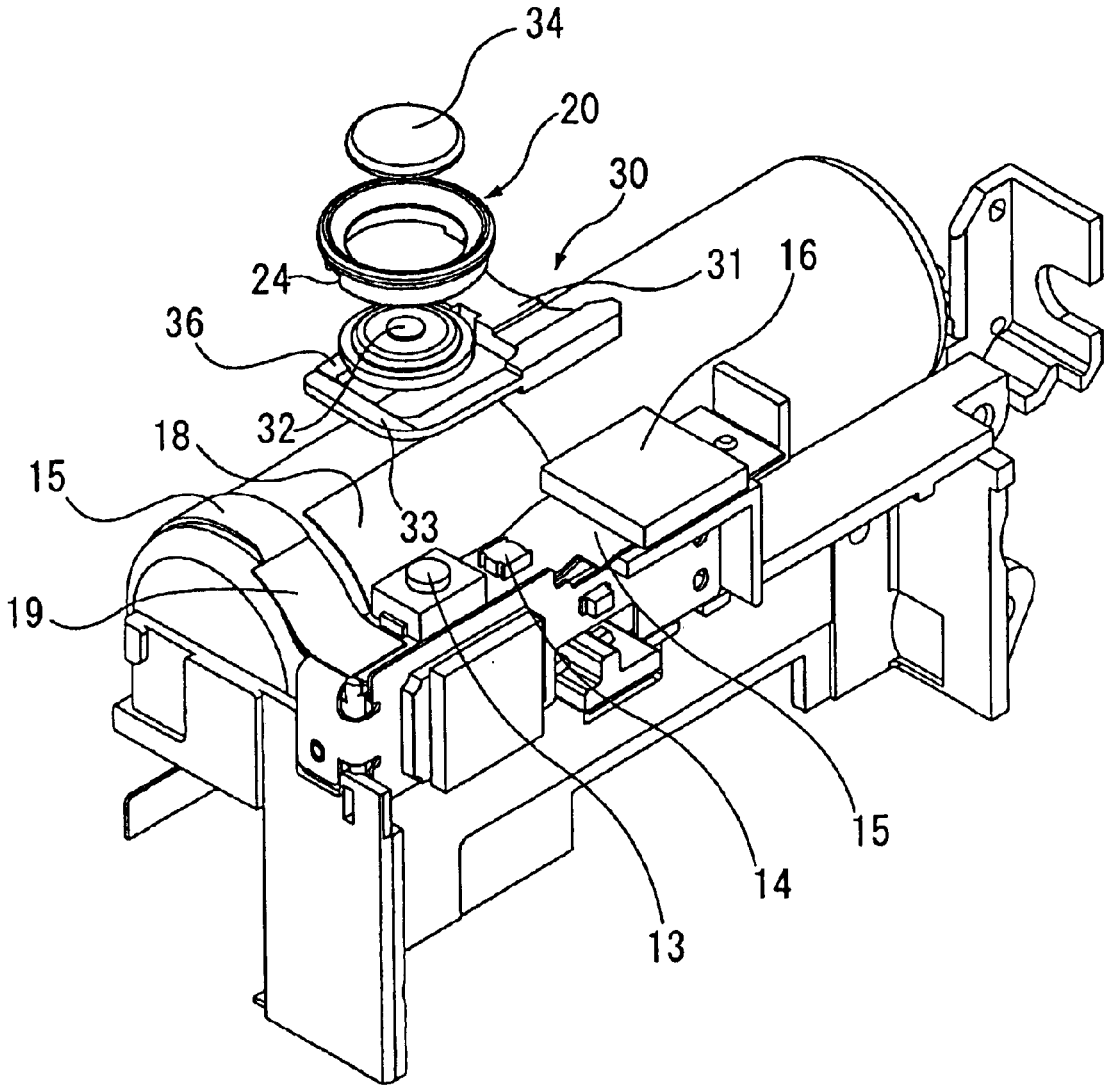
FIG. 4 is an exploded perspective view of the push button device shown in FIG. 1, showing a state after the photoreflective strips are adhered to the peripheral surface of the cylindrical capacitor.
Figure 5:
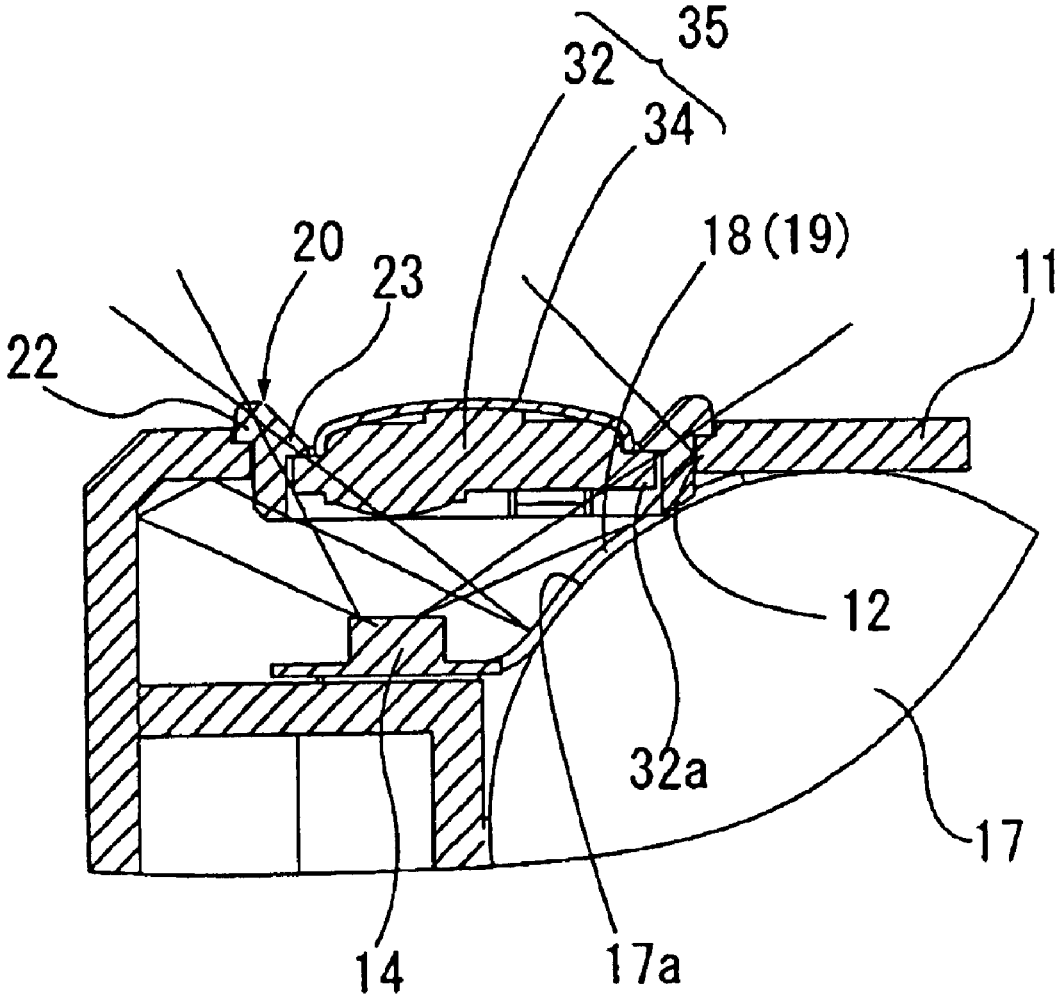
FIG. 5 is a cross sectional view taken along V—V line shown in FIG. 2.
Figure 6:
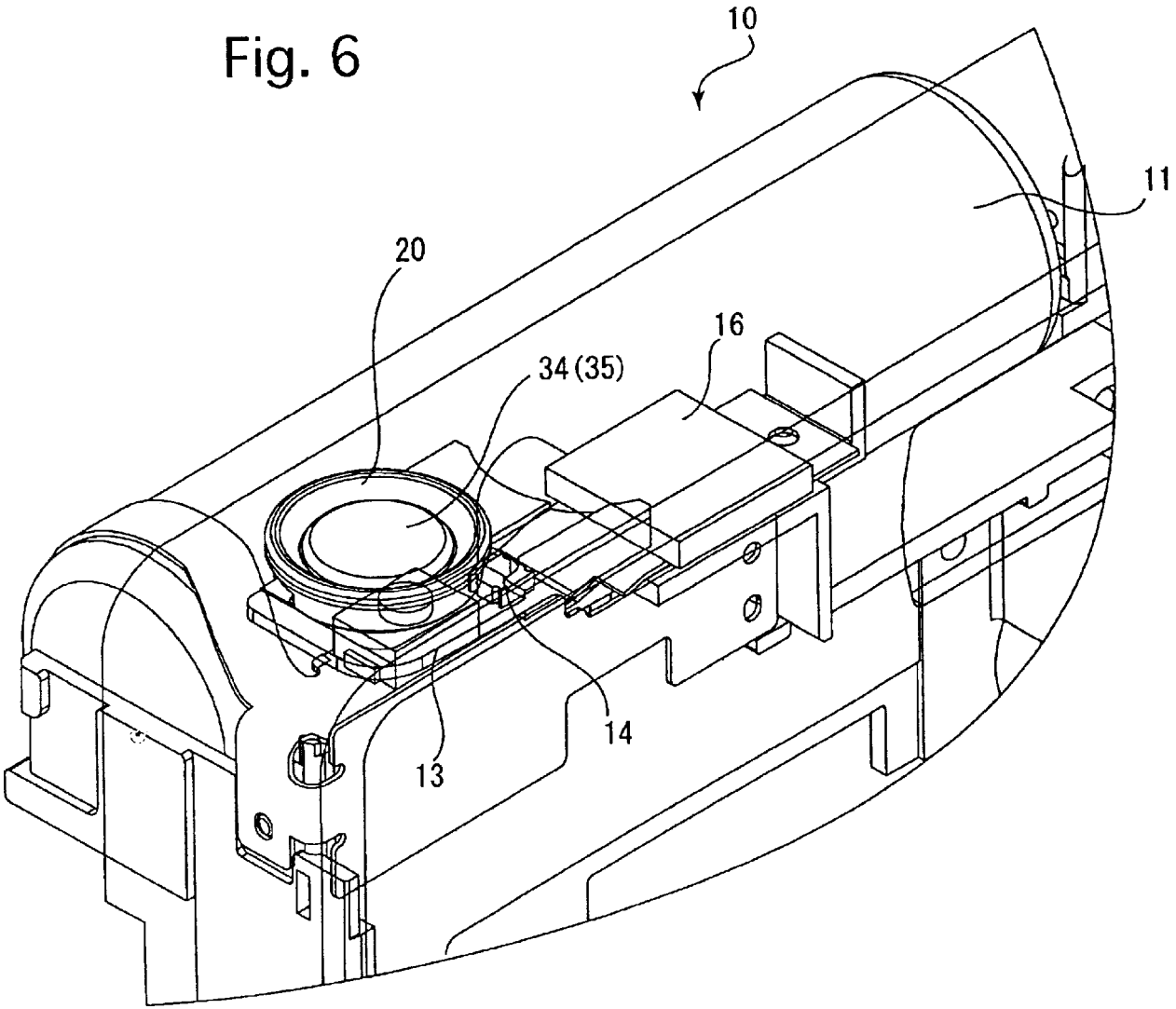
FIG. 6 is a fragmentary perspective view of the push button device shown in FIG. 1.
Figure 7:
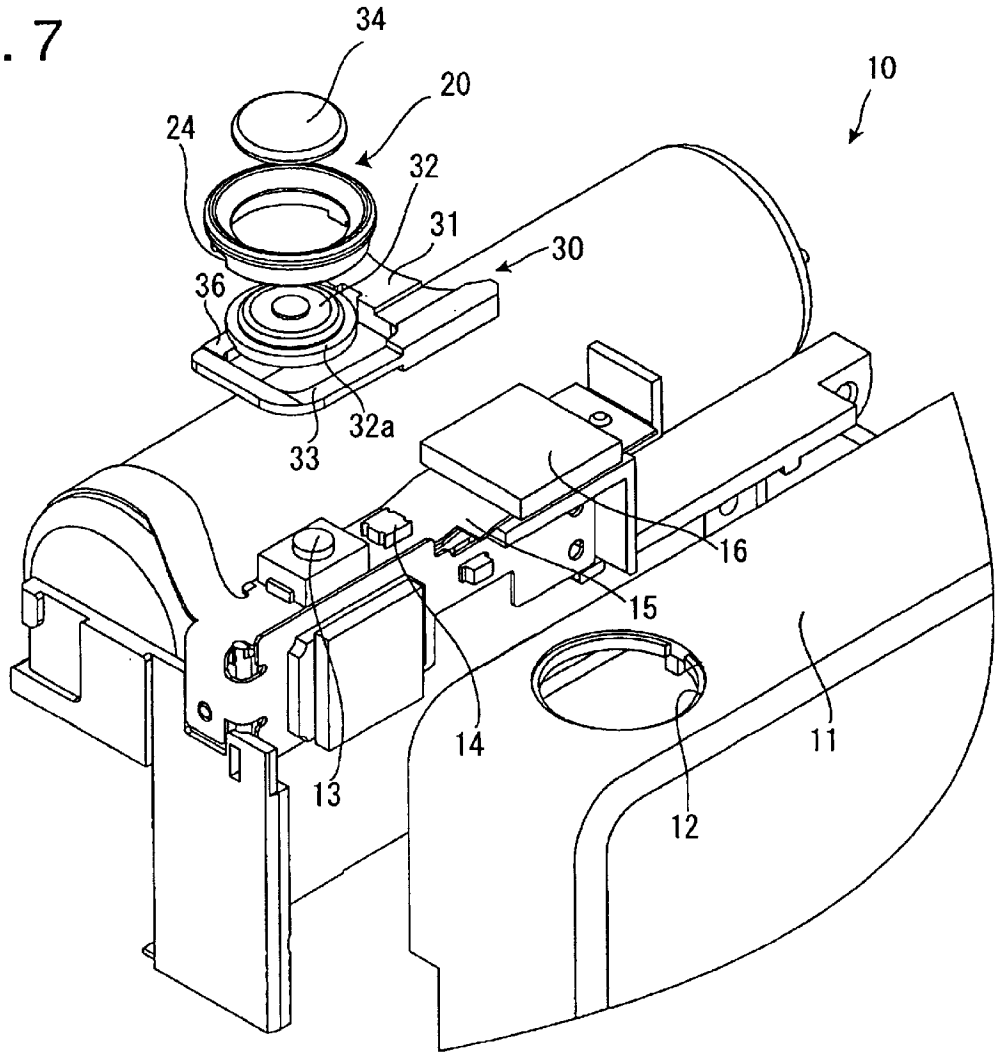
FIG. 7 is an exploded perspective view of the push button device shown in FIG. 6.
Figure 8:
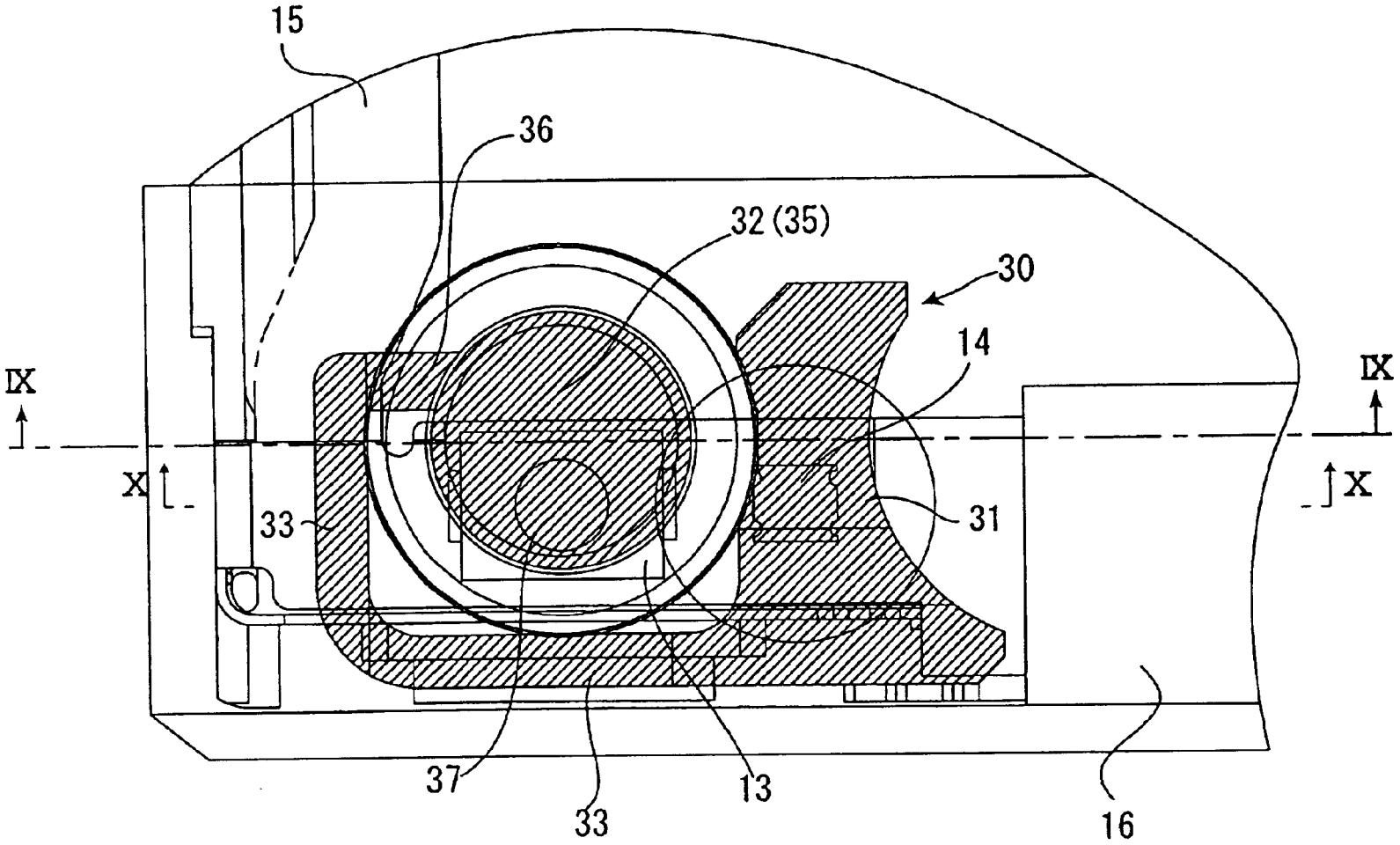
FIG. 8 is a plan view of the push button device shown in FIG. 6.
Figure 9:
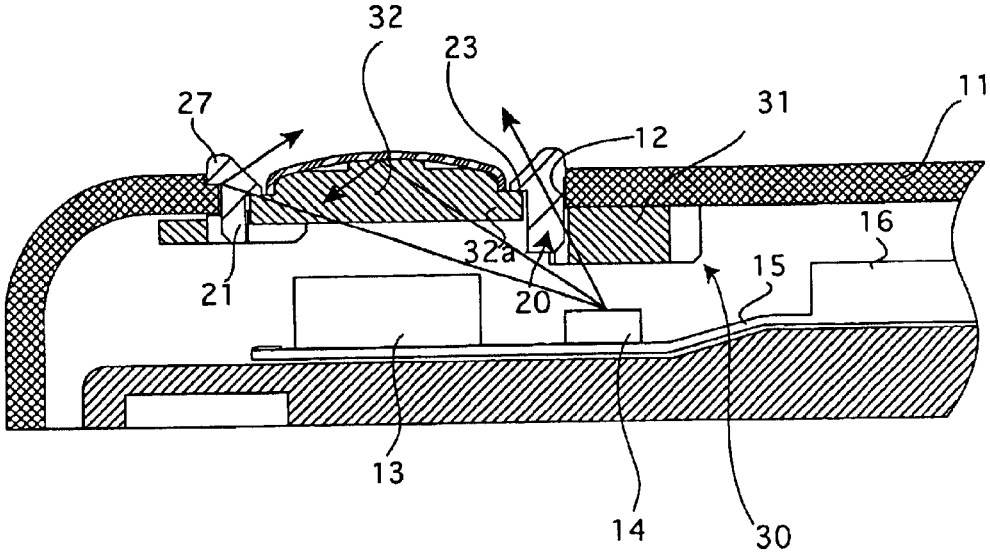
FIG. 9 is a cross sectional view taken along IX—IX line shown in FIG. 8.
Figure 10:
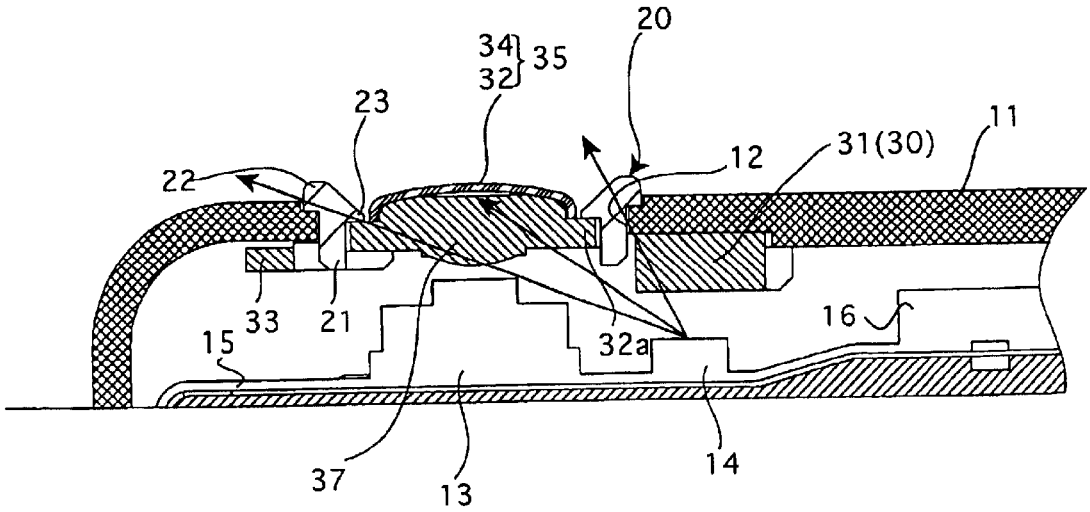
FIG. 10 is a cross sectional view taken along X—X line shown in FIG. 8.

FIGS. 1 through 10 show an embodiment of a push button device according to the present invention which is incorporated in a camera (electronic device) to serve as a power button (ON/OFF button). As shown in FIGS. 3, 5, 6, 7, 9 and 10, a circular through hole 12 is formed on an upper exterior member (body) 11 of the camera 10. The push button device is provided with an annular translucent member (base or seat) 20 molded of light-guiding resin (translucent resin) which is fitted in the circular through hole 12 to be fixed to the upper exterior member 11. The annular translucent member 20 is provided with a hollow cylindrical portion 21 (see FIGS. 9 and 10), an outer flange 22 and an inner flange 23. As shown in FIGS. 5, 9 and 10, the outer flange 22 projects radially outwards from an upper end of the cylindrical portion 21, and the inner flange 23 extends radially inwards from the upper end of the cylindrical portion 21. The outer flange 22 is cemented to that surface of the upper exterior member 11 around the circular through hole 12. The diagonally shaded area in FIG. 2 shows the shape of the annular translucent member in plan view.

The push button device is provided immediately below the upper exterior member 11 with a molded button portion 30. Similar to the annular translucent member 20, the molded button portion 30 is molded of light-guiding resin (translucent resin). The annular translucent member 20 is provided with a fixing portion 31, a button body 32, and a resilient arm 33 which connects the button body 32 with the fixing portion 31. The fixing portion 31 is cemented to an internal surface of the upper exterior member 11 to fix the molded button portion 30 to the upper exterior member 11. The diagonally shaded area in FIG. 8 shows the shape of the annular translucent member in plan view.

The button body 32 is circular in plan view, and is fitted in the cylindrical portion 21 of the annular translucent member 20 to be capable of being depressed from top of the camera 10. A cover cap 34 made of an opaque material such as metal is fixed to a top surface of the button body 32 to fully cover the top surface. The button body 32 and the cover cap 34 constitute a push button 35 (see FIG. 5) of the camera 10. The resilient arm 33 is an L-shape arm which projects from an end of the fixing portion 31, and extends firstly in a rightward direction of the camera 10 (leftwards as viewed in FIGS. 2 and 8) and subsequently in a rearward direction of the camera 10 (upwards as viewed in FIGS. 3 and 7) to half surround the annular translucent member 20. The tip of the resilient arm 33 is fixed to the button body 32. The fixing portion 31 and the button body 32 are adjacent to each other, and the resilient arm 33, which projects from the fixing portion 31, is connected, at the tip of the resilient arm 33, to the portion of the button body 32 on the opposite side of the button body 32 from the fixing portion 31 via a connecting portion 36 formed at the tip of the resilient arm 33. The cylindrical portion 21 is provided with a clearance slot (cutaway portion) 24 for the connecting portion 36 of the resilient arm 33 (see FIGS. 3, 4, 7 and 8).

The above described configuration of the resilient arm 33 makes it possible to secure a sufficient effective length of the resilient arm 33, thus allowing the button body 32 to move up and down along the axis of the button body 32 in the annular translucent member 20. The resilient arm 33 is shaped to bias the button body 32 upwards, i.e., in a direction so that the push button 35 projects through the annular translucent member 20. The button body 32 is provided with a flange 32*a*, an upper surface of which comes in contact with a lower surface of the inner flange 23, to define the upper moving limit of the button body 32 with respect to the annular translucent member 20.

The camera 10 is provided therein immediately below the push button 35 with a switching element 13 having tactile feedback, and is further provided below the fixing portion 31 with an LED (light emitter) 14. Accordingly, the LED 14 is positioned offset from the axis of the push button 35. The button body 32 is provided on a bottom surface thereof with a push stub 37 (see FIGS. 2, 8 and 10) which presses the switching element 13 when the push button 35 is depressed. Upon power being turned ON by pressing the switching element 13, the LED 14 comes on. The switching element 13 and the LED 14 are mounted to a flexible PWB 15 which is fixed to an internal stationary member of the camera 10. The switching element 13 and the LED 14 are electrically connected to a CPU 16 via the flexible PWB 15.

The camera 10 is provided therein adjacent to the molded button portion 30 with a cylindrical capacitor 17. A convex semi-cylindrical surface 17*a* (see FIG. 3) which constitutes a portion of the peripheral surface of the cylindrical capacitor 17 is positioned on a side (on the upper side as viewed in FIG. 2) of the space between the LED 14 and the annular translucent member 20. The cylindrical capacitor 17 serves as a power supply for a built-in flash (not shown) of the camera 10. The axis of the cylindrical capacitor 17 extends alongside of the LED 14 and the annular translucent member 20 in a direction substantially parallel to a direction along which the LED 14 and the annular translucent member 20 are aligned. The annular translucent member 20 and the push button 35 are provided at positions adjacent to the convex semi-cylindrical surface 17*a* so that a direction normal to a tangent plane to the convex semi-cylindrical surface 17*a* extends toward the annular translucent member 20 and the push button 35. As can be clearly seen in FIG. 5, the axis of the cylindrical capacitor 17 is positioned below the LED 14, while the radius of the cylindrical peripheral surface of the cylindrical capacitor 17, a part of which serves as the convex semi-cylindrical surface 17*a*, is set sufficiently greater than the distance between the LED 14 and the push button 35, specifically at least double the distance between the LED 14 and the push button 35. The push button device is provided with two self-adhesive photoreflective strips: a first photoreflective strip 18 and a second photoreflective strip 19 which are adhered to the convex semi-cylindrical surface 17*a* so as not to interfere with the switching element 13 and the LED 14. Specifically, the first photoreflective strip 18 is adhered directly to a part of the convex semi-cylindrical surface 17*a*, while the second photoreflective strip 19 is adhered to the part of the flexible PWB 15 which is adhered to another part of the convex semi-cylindrical surface 17*a* as shown in FIG. 4. Namely, the second photoreflective strip 19 is adhered to the convex semi-cylindrical surface 17*a* via the flexible PWB 15. The surfaces of the first photoreflective strip 18 and the second photoreflective strip 19 have a high reflectivity which is greater than that of the convex semi-cylindrical surface 17*a*. For instance, the first photoreflective strip 18 and the second photoreflective strip 19 are white strips.

In the above described embodiment of the push button device, power of the camera 10 is turned ON to turn ON the LED 14 if the push button 35 (the button body 32) is depressed so that the push stub 37 presses the switching element 13 once. If the push button 35 is depressed again so that the push stub 37 again presses the switching element 13, power of the camera 10 is turned OFF to turn OFF the LED 14. Note that the push button 35 does not illuminate by the light emission of the LED 14 because the top of the button body 32 is fully covered by the opaque cover cap 34.

In a state where the LED 14 is ON, part of the light rays emitted from the LED 14 are reflected by the first photoreflective strip 18 and the second photoreflective strip 19 to be incident directly on the annular translucent member 20, or indirectly on the annular translucent member 20 through the button body 32, as shown by solid lines representing light-path traveling paths in FIG. 5. Since a direction normal to a plane tangent to the convex semi-cylindrical surface 17*a* is toward the annular translucent member 20 and the push button 35 as mentioned above, the light rays reflected by the first photoreflective strip 18 and the second photoreflective strip 19 are given to the annular translucent member 20 with efficiency.

In addition, in a state where the LED 14 is ON, part of the light rays emitted from the LED 14 reach the annular translucent member 20 through the button body 32 (and the fixing portion 31) as shown by solid lines representing light-path traveling paths in FIGS. 9 and 10. This makes it possible to illuminate the annular translucent member 20 far more uniformly than the case using a conventional button body made of opaque resin instead of the button body 32 that is made of translucent resin.

Although it is desirable that the button body 32 be made of light-guiding material (translucent material), the button body 32 can be made of opaque material. The first photoreflective strip 18 and the second photoreflective strip 19 can be provided as a single photoreflective strip.

In the above illustrated embodiment of the push button device, since a cylindrical capacitor is adopted as a capacitor absolutely necessary for the built-in flash of the camera 10 and since the peripheral surface of the cylindrical capacitor is partly used to serve as the convex semi-cylindrical surface 17*a*, it is unnecessary to provide a special convex semi-cylindrical surface. However, a special convex semi-cylindrical surface corresponding to the convex semi-cylindrical surface 17*a* can be provided in an electronic device if no capacitor is accommodated therein. Although the annular translucent member 20 has a perfect circular shape in plan view in the above illustrated embodiment of the push button device, the annular translucent member 20 can be an annular member having an oval or other shape in plan view.

Although the above illustrated embodiment of the push button device serves as a power button (ON/OFF button) of the camera 10 so that the annular translucent member 20 lights up when power of the camera 10 is turned ON, the present invention can be applied to any other cases where an annular member corresponding to the annular translucent member 20 lights up in a specific condition other than the power-on condition.

As can be understood from the foregoing, according to the present invention, a push button device having an illuminator for illuminating an annular translucent member provided around a push button is achieved, wherein the annular translucent member can be illuminated uniformly with efficiency by the illuminator.

Obvious changes may be made in the specific embodiment of the present invention described herein, such modifications being within the spirit and scope of the invention claimed. It is indicated that all matter contained herein is illustrative and does not limit the scope of the present invention.

What is claimed is:

1. A push button device for an electronic device comprising:

an annular translucent member fixed to a body of said electronic device;

a push button positioned in said annular translucent member to be capable of being depressed;

a light emitter for illuminating said annular translucent member;

a convex semi-cylindrical surface which is a portion of a complete cylindrical surface, and is positioned on a side of a space between said light emitter and said annular translucent member; and at least one photoreflective sheet adhered to said convex semi-cylindrical surface, wherein an axis of said complete cylindrical surface extends in a direction substantially parallel to a direction along which said light emitter and said annular translucent member are aligned, and wherein a direction normal to a tangent plane to said convex semi-cylindrical surface extends toward said annular translucent member and said push button.

2. The push button device according to claim 1, wherein said annular translucent member is made of translucent resin.

3. The push button device according to claim 1, wherein a radius of said complete cylindrical surface is at least double a distance between said light emitter and said push button.

4. The push button device according to claim 1, wherein said push button comprises:

a button body made of translucent resin; and an opaque cover cap which covers a top of said push button.

5. The push button device according to claim 1, wherein said convex semi-cylindrical surface is a portion of a peripheral surface of a cylindrical capacitor.

6. The push button device according to claim 5, wherein said electronic device comprises a camera.

7. The push button device according to claim 6, wherein said cylindrical capacitor serves as a power source for supplying power to a built-in flash of said camera.

8. The push button device according to claim 6, wherein said push button device serves as a power button of said camera.

9. A push button device for electronic device comprising:

an annular translucent member fixed to a body of said electronic device;

a push button positioned in said annular translucent member to be capable of being depressed;

a light emitter for illuminating said annular translucent member;

a convex semi-cylindrical surface which is positioned adjacent to the space between said light emitter and said annular translucent member to face said light emitter and said annular translucent member; and at least one photoreflective sheet adhered to said convex semi-cylindrical surface.

10. A push button device for electronic device comprising:

an annular translucent member fixed to a body of said electronic device;

a push button positioned in said annular translucent member to be capable of being depressed; and a light emitter for illuminating said annular translucent member, wherein said push button comprises a button body made of translucent resin, and an opaque cover cap which covers a top of said push button, and wherein said button body, said annular translucent member and said light emitter are positioned so that at least a part of light rays emitted from said light emitter is incident on said annular translucent member through said button body.

11. The push button device according to claim 10, further comprising a molded button portion with which said button body is formed integral, said molded button portion comprising:

a fixing portion which is fixed to a stationary member of said electronic device; and a resilient arm which connects said button body with said fixing portion, wherein said molded button portion is molded from translucent resin.

12. The push button device according to claim 11, wherein said annular translucent member and said fixing portion of said molded button portion are fixed to an exterior member of said electronic device, and wherein said light emitter is positioned internal side of said fixing portion.

13. The push button device according to claim 12, wherein said button body and said fixing portion are adjacent to each other, and wherein said resilient arm projects from said fixing portion so that a tip of said resilient arm is fixed to said button body on a portion thereof on an opposite side of said button body from said fixing portion.

14. The push button device according to claim 10, wherein said electronic device comprises a camera.

15. The push button device according to claim 14, wherein said push button device serves as a power button of said camera.

* * * * *